US012104304B2

(12) United States Patent
Dillon

(10) Patent No.: US 12,104,304 B2
(45) Date of Patent: Oct. 1, 2024

(54) LAUNDRY APPARATUS INCLUDING A TANGLE-FREE OPTION AND METHOD OF OPERATING A LAUNDRY APPARATUS

(71) Applicant: Haier US Appliance Solutions, Inc., Wilmington, DE (US)

(72) Inventor: Nicholas Matthew Dillon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 788 days.

(21) Appl. No.: 17/204,409

(22) Filed: Mar. 17, 2021

(65) Prior Publication Data

US 2022/0298693 A1 Sep. 22, 2022

(51) Int. Cl.

| | |
|---|---|
| ***D06F 33/36*** | (2020.01) |
| ***D06F 33/34*** | (2020.01) |
| ***D06F 33/38*** | (2020.01) |
| ***D06F 34/28*** | (2020.01) |
| ***D06F 105/02*** | (2020.01) |
| ***D06F 105/46*** | (2020.01) |
| ***D06F 105/52*** | (2020.01) |

(52) U.S. Cl.

CPC ..... *D06F 33/36* (2020.02); *D06F 33/34* (2020.02); *D06F 33/38* (2020.02); *D06F 34/28* (2020.02); *D06F 2105/02* (2020.02); *D06F 2105/46* (2020.02); *D06F 2105/52* (2020.02)

(58) Field of Classification Search

CPC ..... D06F 33/34; D06F 33/36; D06F 33/38; D06F 34/28; D06F 2105/02; D06F 2105/46; D06F 2105/52

See application file for complete search history.

(56) References Cited

U.S. PATENT DOCUMENTS

| | | | | |
|---|---|---|---|---|
| 3,131,797 | A * | 5/1964 | Bochan | F16D 43/18 192/114 R |
| 5,605,062 | A | 2/1997 | Park | |
| 5,839,299 | A | 11/1998 | Lee | |
| 6,446,473 | B1 | 9/2002 | Ho | |
| 6,665,953 | B2 | 12/2003 | Yong | |
| 7,047,583 | B2 | 5/2006 | Kim | |
| 7,171,714 | B2 | 2/2007 | Kim | |
| 7,721,462 | B2 | 5/2010 | Cho | |
| 7,739,765 | B2 | 6/2010 | Ashrafzadeh | |
| 7,950,255 | B2 | 5/2011 | Ashrafzadeh | |
| 8,448,481 | B2 | 5/2013 | Cho | |
| 8,601,836 | B2 | 12/2013 | Kim | |
| 9,127,388 | B2 | 9/2015 | Chung | |

(Continued)

FOREIGN PATENT DOCUMENTS

| | | | |
|---|---|---|---|
| CN | 105088614 | A | 11/2015 |
| JP | H03264089 | A | 11/1991 |

(Continued)

*Primary Examiner* — Joseph L. Perrin

(74) *Attorney, Agent, or Firm* — Dority & Manning, P.A.

(57) ABSTRACT

A method of operating a laundry treatment apparatus includes receiving a tangle-free selection signal corresponding to a tangle-free option distinct from a default option, adjusting one or more parameters of an agitation cycle according to the tangle-free option in response to receiving the tangle-free selection signal, and initiating a washing operation incorporating the one or more adjusted parameters.

13 Claims, 4 Drawing Sheets

(56) References Cited

U.S. PATENT DOCUMENTS

| | | | | |
|---|---|---|---|---|
| 9,139,944 | B2 | 9/2015 | Kim | |
| 9,200,401 | B2 | 12/2015 | Chung | |
| 9,469,928 | B2 | 10/2016 | Kim | |
| 10,214,843 | B2 | 2/2019 | Kim | |
| 2003/0184597 | A1* | 10/2003 | Jo | D06F 34/32 715/810 |
| 2007/0186356 | A1* | 8/2007 | Kwon | D06F 34/18 68/12.02 |
| 2010/0000267 | A1 | 1/2010 | Leidig | |
| 2011/0030150 | A1* | 2/2011 | Ashrafzadeh | D06F 58/36 68/19 |
| 2011/0061172 | A1* | 3/2011 | Koo | D06F 33/48 68/139 |
| 2017/0342629 | A1 | 11/2017 | Gwon | |
| 2022/0049398 | A1* | 2/2022 | Kwon | D06F 33/47 |
| 2022/0349102 | A1* | 11/2022 | Yun | G06V 40/10 |

FOREIGN PATENT DOCUMENTS

| | | | |
|---|---|---|---|
| JP | H05192486 | A | 8/1993 |
| JP | 2020006023 | A | 1/2020 |
| WO | WO2015005752 | A1 | 1/2015 |
| WO | WO2018196129 | A1 | 11/2018 |

* cited by examiner

LAUNDRY APPARATUS INCLUDING A TANGLE-FREE OPTION AND METHOD OF OPERATING A LAUNDRY APPARATUS

FIELD OF THE INVENTION

The present subject matter relates generally to laundry treatment apparatuses, and more particularly to laundry treatment apparatuses incorporating tangle-free options and methods for operating laundry treatment apparatuses.

BACKGROUND OF THE INVENTION

Washing machine appliances generally include a cabinet which receives a wash tub for containing water or wash fluid (e.g., water and detergent, bleach, or other wash additives). A wash basket is rotatably mounted within the wash tub and defines a wash chamber for receipt of articles for washing. A drive assembly is coupled to the wash tub and configured to selectively rotate the wash basket within the wash tub.

Washing machine appliances are typically equipped to perform one or more modes or cycles, such as agitation, rinse, and spin cycles. For example, during an agitation or rinse cycle, the wash fluid is directed into the wash tub in order to wash and/or rinse articles within the wash chamber. In addition, the wash basket and/or an agitator can rotate at various speeds to agitate or impart motion to articles within the wash chamber. During a spin cycle, the wash basket may be rotated at high speeds, e.g., to wring wash fluid from articles within the wash chamber.

Some laundry articles may be susceptible to tangling within the wash basket, i.e., with each other or around the agitator. In detail, various attributes or parameters of the agitation cycle, for example, may increase the frequency of tangling of articles. This may in turn reduce the washing efficacy of the washing machine appliance. Additionally or alternatively, tangling may cause damage to certain articles or damage to the wash tub or agitator. Accordingly, improved methods and apparatuses that prevent or mitigate tangling during a washing operation would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a laundry treatment appliance is provided. The laundry treatment appliance may include a tub, a wash basket rotatably provided within the tub, and an agitator rotatably provided within the wash basket. The method may include receiving a tangle-free selection signal corresponding to a tangle-free option distinct from a default option; adjusting one or more parameters of an agitation cycle according to the tangle-free option in response to receiving the tangle-free selection signal, the one or more adjusted parameters corresponding to a supplied water volume to the tub and being distinct from one or more unadjusted parameters of the default option; and initiating a washing operation incorporating the one or more adjusted parameters.

In another exemplary aspect of the present disclosure, a method of operating a laundry treatment appliance is disclosed. The laundry appliance may include a tub, a wash basket rotatably provided within the tub, and an agitator rotatably provided within the wash basket. The method may include receiving a tangle-free selection signal corresponding to a tangle-free option distinct from a default option; adjusting one or more parameters of an agitation cycle according to the tangle-free option in response to receiving the tangle-free selection signal, the one or more adjusted parameters corresponding to a directed movement of the agitator and being distinct from one or more unadjusted parameters of the default option; and initiating a washing operation incorporating the one or more adjusted parameters.

In still another exemplary aspect of the present disclosure, a laundry treatment apparatus is disclosed. The laundry treatment apparatus may include a cabinet; a tub provided within the cabinet and configured to hold water; a wash basket rotatably provided within the tub; an agitator rotatably provided within the wash basket; a control panel attached to the cabinet through which inputs may be entered; and a controller in communication with the control panel, the wash basket, and the agitator, the controller configured to perform a series of operations. The series of operations may include receiving a tangle-free selection signal corresponding to a tangle-free option distinct from a default option; adjusting one or more parameters of an agitation cycle according to the tangle-free option in response to receiving the tangle-free selection signal, the one or more adjusted parameters corresponding to a directed movement of the agitator and being distinct from one or more unadjusted parameters of the default option; and initiating a washing operation incorporating the one or more adjusted parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
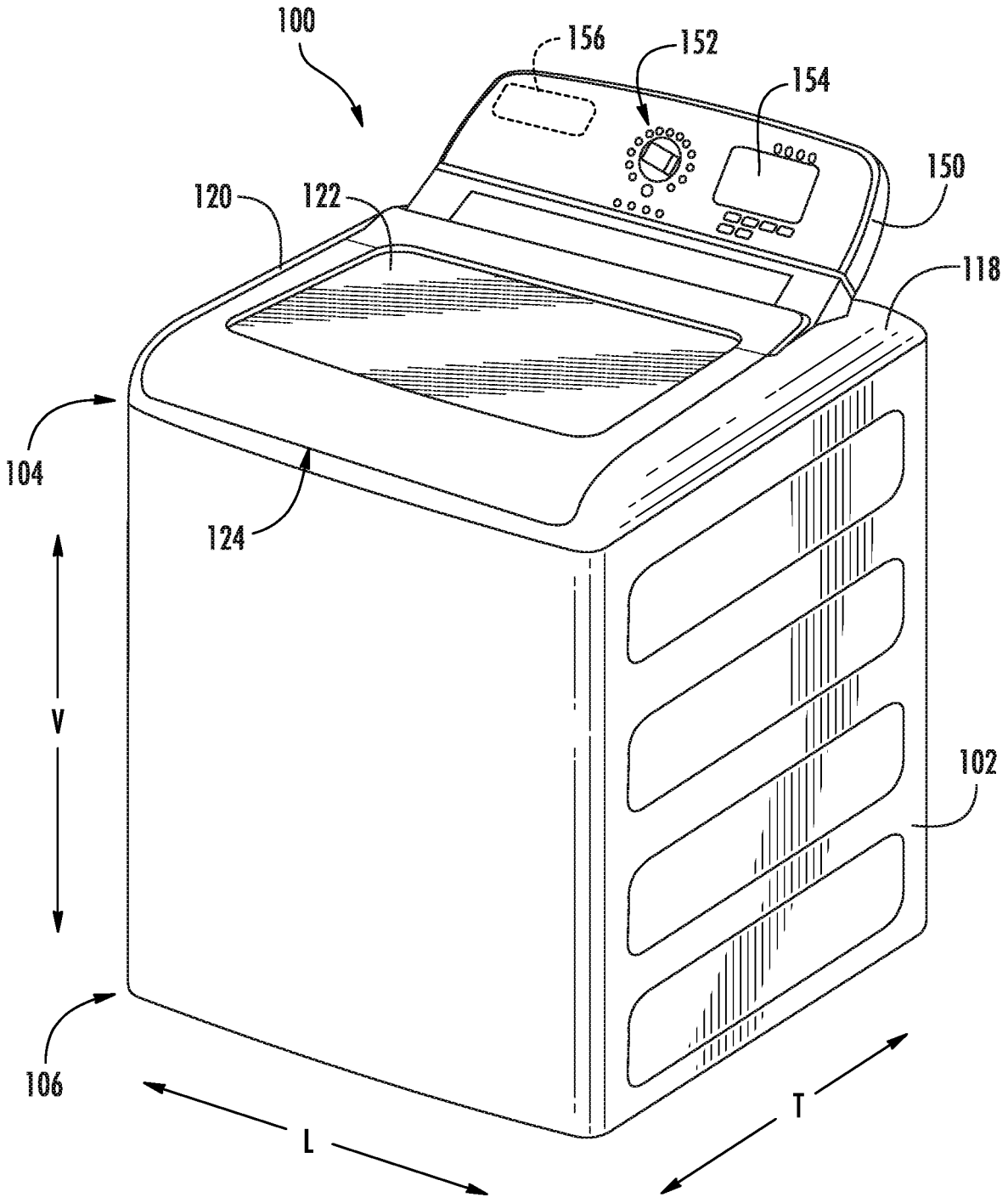
FIG. 1 provides a perspective view of a washing machine appliance according to an exemplary embodiment of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
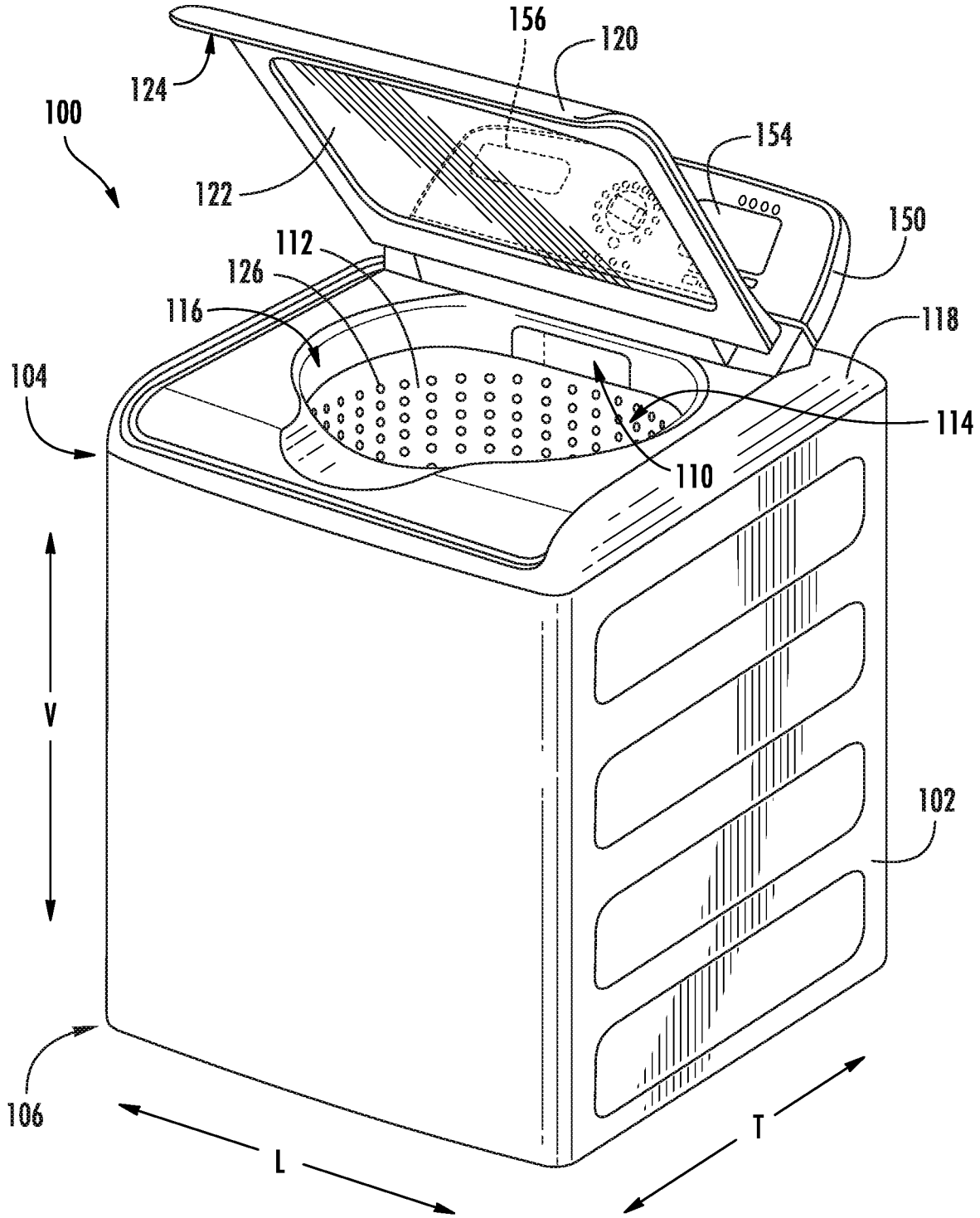
FIG. 2 provides a perspective view of the washing machine appliance of FIG. 1 with the door of the exemplary washing machine appliance shown in an open position.
Figure 3:
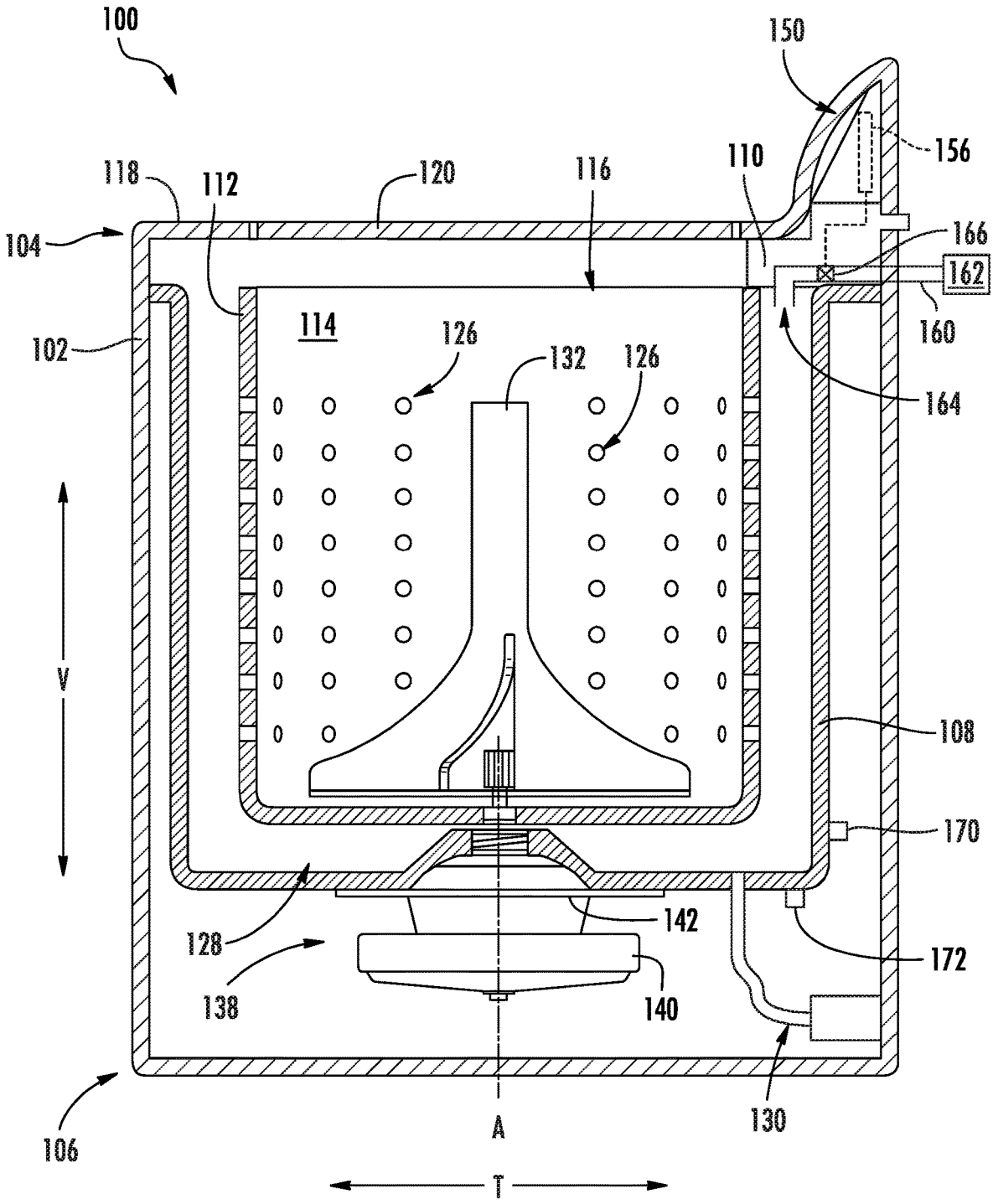
FIG. 3 provides a side, cross sectional view of the washing machine appliance of FIG. 1 according to an exemplary embodiment of the present subject matter.

FIGS. 1 through 3 illustrate an exemplary embodiment of a vertical axis washing machine appliance or laundry treatment apparatus 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis washing machine, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle. Washing machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 112 that is positioned within tub 108 and generally defines a wash chamber 114 including an opening 116 for receipt of articles for washing. More specifically, wash basket 112 is rotatably mounted within tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, as noted above, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Washing machine appliance 100 further includes a pump assembly 130 (FIG. 3) that is located beneath tub 108 and wash basket 112 for gravity assisted flow when draining tub 108, e.g., after a wash or rinse cycle.

An impeller or agitator 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitator 132 extends into wash basket and assists agitation of articles disposed within wash basket 112 during operation of washing machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, washing machine appliance 100 includes a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is communicatively coupled with control panel 150 for user manipulation to select washing machine cycles and features. In response to user manipulation of control panel 150, controller 156 operates the various components of washing machine appliance 100 to execute selected machine cycles and features. As described in more detail below with respect to FIG. 5, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

Referring to FIG. 3, washing machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, washing machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. In addition, washing machine appliance 100 may include one or more pressure sensors 170, 172 for detecting the amount of water and or clothes within tub 108. For example, pressure sensor 170 may be operably coupled to a side of tub 108 for detecting the weight of tub 108.

Figure 4:
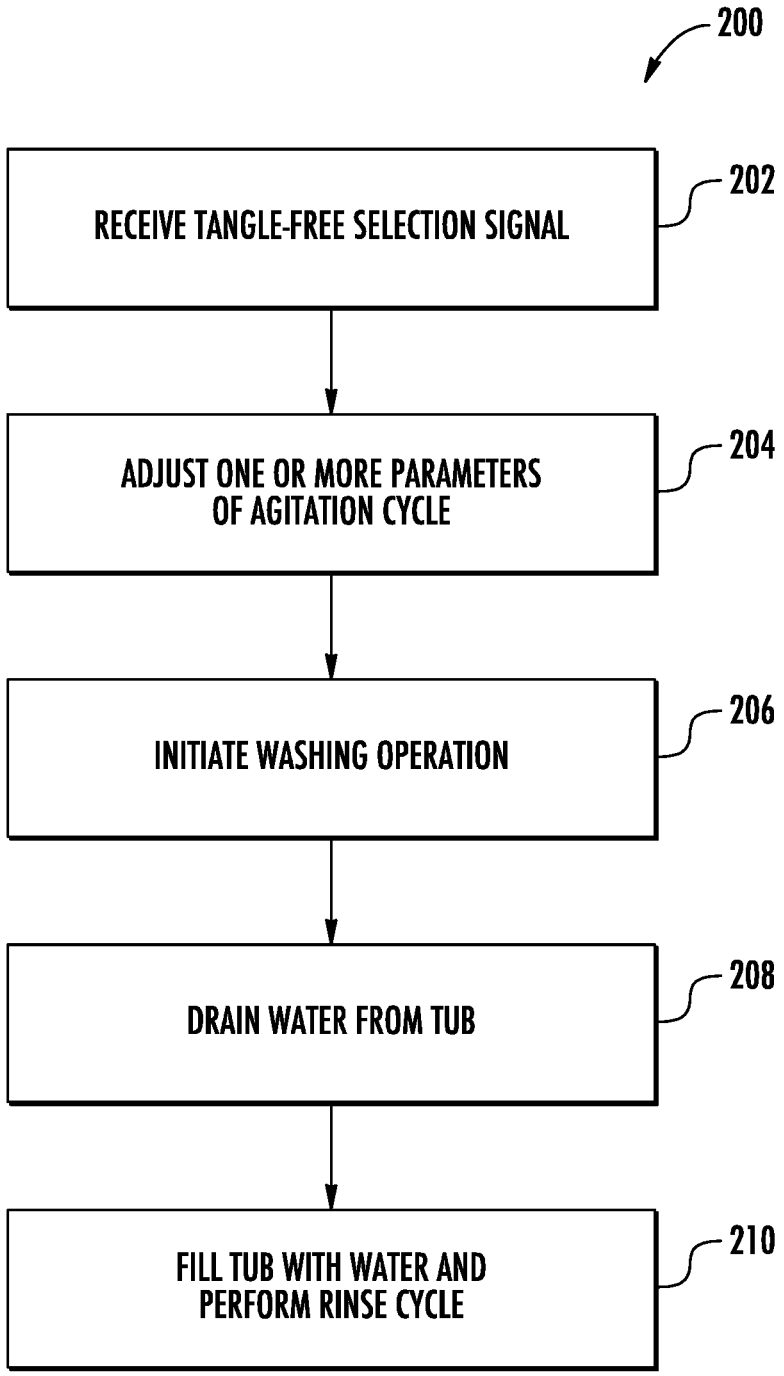
FIG. 4 provides a flow chart illustrating a method of operating a washing machine appliance according to an exemplary embodiment.

FIG. 4 provides a flow diagram of an exemplary method 200 for operating a washing machine appliance according to example embodiments of the present subject matter. For instance, the exemplary method 200 may be utilized to operate the washing machine appliance 100 and components thereof of FIGS. 1 through 3. Accordingly, the method 200 will be described below in the context of operating washing machine appliance 100. However, it will be appreciated that the exemplary method 200 is applicable to operation of a variety of other washing machine appliances, such as horizontal axis washing machine appliances. Further, it should be appreciated that variations and modifications to method 200 (e.g., the repetition or reordering of certain steps) are possible and within the scope of the present subject matter.

At 202, the method 200 includes receiving a tangle-free selection signal. The tangle-free selection signal may correspond to a tangle-free option which may be registered by the washing machine appliance. For instance, the tangle-free option may be different from a default option. In detail, the washing machine appliance may be configured to perform a multitude of washing operations according to multiple washing options (e.g., a default option, a tangle-free option, a delicate option, etc.). In order to select a desired option, a user may press a button (e.g., via input selector 152 or the like) on the washing machine appliance corresponding to the desired option. The option may be a series of parameters applied to a specific washing operation. Accordingly, the washing operation may be performed according to the parameters of the selected option (e.g., default, tangle-free, etc.). A signal may then be sent to a controller (e.g., controller 156) to implement the selected option. The tangle-free option may be selected by the user before the washing operation is initiated. In detail, the controller may restrict the user from selecting the tangle-free option after the washing operation has commenced.

In one embodiment, the default option includes parameters or instructions for a default agitation cycle, a default rinse cycle, and a default spin cycle. The default option may include instructions for additional cycles, including a second agitation cycle, a second rinse cycle, or the like. In detail, a default agitation cycle may include a first predetermined water volume to be supplied to a wash tub. For instance, upon commencing the washing operation under a default option, the controller may instruct the washing machine appliance to supply the first predetermined water volume to a wash tub (e.g., wash tub 108). The first predetermined water volume may be determined based on a load characteristic, such as a load size, a load weight, a property of the wash articles (e.g., cottons, linens, towels, etc.), or the like, which may be manually input by the user or automatically measured/detected, as would be understood.

Additionally or alternatively, the default agitation cycle under the default option may include a parameter or setting for a default rotational velocity (e.g., measured in rotations per minute) of an agitator (e.g., agitator 132) within a wash basket (e.g., wash basket 112). In detail, according to the default agitation cycle, the agitator may be rotated within the wash basket at a first predetermined rotational velocity. The agitator may be rotated in the same direction as a rotational direction of the wash basket. The agitator may be rotated in an opposite direction as the rotational direction of the wash basket. Additionally or alternatively, the agitator may be rotated at a different rotational velocity from a rotational velocity of the wash basket. Additionally or alternatively, the agitator may be rotated at the same rotational velocity as the rotational velocity of the wash basket.

The default agitation cycle under the default option may include a default rotational arc length of the agitator within the wash basket. In detail, during the default agitation cycle, the agitator may be rotated through a first predetermined arc length (e.g., measured in degrees about the rotational axis). The first predetermined arc length may be measured relative to the wash basket or relative to the wash tub. In other words, as the wash basket is rotated within the wash tub, the agitator may rotate through the first predetermined arc length with respect to the already rotating wash basket. Additionally or alternatively, the agitator may be rotated through the first predetermined arc length with respect to the stationary wash tub. The first predetermined arc length may alternately be referred to as a rotational dwell time, an active rotation time, or a stroke time. In some embodiments, the first predetermined stroke time may be between 2 seconds and 3 seconds for which the agitator is rotated at a set rotational velocity.

At step 204, method 200 may include adjusting one or more parameters of the agitation cycle according to the tangle-free option in response to determining that the tangle-free option has been selected. Once the controller receives the tangle-free selection signal, the controller may then adjust or alter one or more parameters of the agitation cycle to be different from the parameters according to the default option. The one or more parameters may include a water volume, an agitator rotational velocity, an agitator rotational arc length, of the like. In detail, a user may insert certain wash articles having tendencies to become tangled within wash basket, for instance, around the agitator, with each other, or with the wash basket. Accordingly, adjusting one or more parameters of the agitation stroke may significantly reduce or mitigate the instances of entanglement.

In some embodiments, 204 includes adjusting the water volume supplied to the wash tub. For instance, the controller may adjust the water volume supplied to the wash tub for the agitation cycle (e.g., the tangle-free agitation cycle). In detail, the controller may instruct the washing machine appliance to supply a second predetermined water volume to the wash tub for the tangle-free agitation stroke. The second predetermined water volume may be less than the first predetermined water volume. The second predetermined water volume may be a predetermined fraction or percentage of the first predetermined water volume. In some embodiments, the second predetermined water volume is determined based on the attributes of the wash articles within the wash basket (e.g., cottons, linens, towels, etc.). According to at least one embodiment, the controller may calculate the second predetermined water volume such that the wash articles within the wash tub are not submerged. For instance, a bulk of the wash articles may be estimated (e.g., based on weight and/or user input), and the second predetermined water volume may be calculated based on the estimated bulk to restrict the wash articles from being suspended in water while in the wash tub.

In additional or alternative embodiments, 204 includes adjusting the rotational velocity of the agitator. For instance, the controller may adjust a rotational velocity of the agitator within the drum during the agitation stroke of the agitation cycle. In detail, the agitation stroke may be defined as a rotational movement of the agitator within the wash basket. For instance, the agitation cycle (e.g., the tangle-free agitation cycle) may include multiple agitation strokes (e.g., tangle-free agitation strokes) during the agitation cycle. The agitation strokes may be performed bi-directionally (e.g., clockwise and counterclockwise). Accordingly, the rotational velocity may be adjusted for each agitation stroke during the agitation cycle. In detail, the rotational velocity of the agitator may be reduced when the tangle-free option is selected (e.g., with respect to a rotational velocity of the agitator during the default option). The rotational velocity of the agitator may be reduced by a predetermined fraction or percentage with respect to the default option. In some embodiments, the rotational velocity of the agitator is reduced by a number of revolutions per minute (RPM). The rotational velocity of the agitator during the normal agitation stroke may be between about 130 RPM and about 150 RPM, and the rotational velocity of the agitator during the tangle-free agitation stroke may be between about 100 RPM and about 125 RPM. In one example, the rotational velocity of the agitator during the normal agitation stroke is about 135 RPM, and the rotational velocity of the agitator during the tangle-free agitation stroke is about 120 RPM.

In further additional or alternative embodiments, 204 may include adjusting the rotational arc length of the agitator. For instance, the controller may adjust a rotational arc length of the agitator within the wash basket during the agitation stroke (e.g., the tangle-free agitation stroke). In detail, as described above, during the agitation stroke, the agitator may rotate through a predetermined arc length or a predetermined stroke time (e.g., with respect to the wash basket or the wash tub). The controller may reduce the predetermined arc length or predetermined stroke time by a fraction or percentage (e.g., with respect to an arc length or stroke time of a normal agitation stroke). For instance, a stroke time during a normal agitation stroke may be between about 2 seconds and about 4 seconds, and a stroke time during a tangle-free agitation stroke may be between about 1.5 seconds and about 2 seconds (e.g., with the same rotational velocity or a lower rotational velocity). In one example, the stroke time during a normal agitation stroke is about 2.5 seconds, and the stroke time during a tangle-free agitation stroke is about 1.7 seconds.

At step 206, method 200 may include initiating the washing operation incorporating the one or more adjusted parameters. After the controller determines that the tangle-free option has been selected, the controller may then incorporate one or more of the adjusted parameters into the washing cycle. For instance, the controller may instruct the washing machine appliance to supply the second predetermined water volume to the wash tub for the agitation cycle. In some embodiments, the controller instructs the washing machine appliance to supply the second predetermined water volume to the wash tub and instructs the agitator to rotate at the reduced rotational velocity for the agitation cycle. In some embodiments, the controller instructs the washing machine appliance to supply the second predetermined water volume to the wash tub, instructs the agitator to rotate at the reduced rotational velocity, and instructs the agitator to rotate for the reduced stroke time for the agitation cycle. It should be noted that any combination of the adjusted parameters may be included in the tangle-free wash option according to various applications and embodiments.

When initiating the washing operation, the adjusted parameters may be applied to one or more of the cycles included in the washing operation. For instance, the adjusted parameters may be applied to a rinse cycle or spin cycle in addition to the agitation cycle (or multiple agitation cycles). Additionally or alternatively, any variations on cycles may incorporate the adjusted parameters. Additionally or alternatively, subsequent cycles to the agitation cycle may return to the default option. For instance, during the agitation cycle (or multiple agitation cycles), the controller may instruct the washing machine appliance to apply the one or more adjusted parameters. Subsequently, the controller may instruct the washing machine to apply the normal parameters for any additional cycles. In one example, the second predetermined water volume (e.g., reduced water volume) may be applied for the agitation cycle, and the first predetermined water volume (e.g., normal water volume) may be applied for a rinse cycle.

For instance, at step 206, before initiating the washing operation, the controller may instruct the washing machine appliance to supply the second predetermined water volume to the tub and perform the tangle-free agitation cycle. As mentioned previously, the second water volume may be less than the first water volume, such that the wash articles are not suspended within the wash basket. Subsequently, at step 208, the controller may instruct the washing machine appliance to drain the second predetermined water volume from the tub. The controller may then instruct the washing machine appliance to supply the first predetermined water volume to the tub and perform the rinse cycle, for example, at step 210. Accordingly, the rinse cycle may be performed under default conditions (e.g., using a default water volume).

Advantageously, by adjusting one or more parameters during a cycle (e.g., agitation cycle) of a washing operation, entanglement of wash articles may be reduced throughout the washing operation. Thus, a more thorough wash may be completed resulting in higher satisfaction and cleaner wash articles. Additionally or alternatively, damage to the wash articles and the washing machine appliance may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry treatment appliance, the laundry appliance comprising a tub, a wash basket rotatably provided within the tub, an agitator rotatably provided within the wash basket, and a control panel through which inputs are entered to the laundry treatment appliance, the method comprising:

receiving, via a user input to the control panel, a tangle-free selection signal for a washing operation corresponding to a tangle-free option distinct from a default option, the washing operation comprising an agitation cycle;

adjusting one or more parameters of the agitation cycle to define a set of adjusted parameters according to the tangle-free option in response to receiving the tangle-free selection signal, the one or more parameters comprising a water volume, a rotational velocity of the agitator, or a rotational arc length of the agitator, wherein the set of adjusted parameters is distinct from one or more unadjusted parameters of the default option; and initiating the washing operation incorporating the set of adjusted parameters.

2. The method of claim 1, wherein adjusting the one or more parameters of the agitation cycle comprises:

reducing, relative to the default option, the rotational velocity of the agitator within the wash basket during the agitation cycle.

3. The method of claim 1, wherein the one or more adjusted parameters comprises a rotational stroke time of the agitator within the wash basket during the agitation cycle.

4. The method of claim 3, wherein adjusting the one or more parameters of the agitation cycle comprises:

reducing, relative to the default option, the rotational stroke time of the agitator within the wash basket during the agitation stroke.

5. The method of claim 1, wherein the tangle-free option is selected by a user before the washing operation is initiated.

6. The method of claim 1, wherein the laundry treatment apparatus is a vertical axis washing machine.

7. A laundry treatment apparatus, comprising:

a cabinet;

a tub provided within the cabinet and configured to hold water;

a wash basket rotatably provided within the tub;

an agitator rotatably provided within the wash basket;

a control panel attached to the cabinet through which inputs may be entered; and a controller in communication with the control panel, the wash basket, and the agitator, the controller configured to perform a series of operations, the series of operations comprising:

receiving, via a user input to the control panel, a tangle-free selection signal for a washing operation corresponding to a tangle-free option distinct from a default option, the washing operation comprising an agitation cycle;

adjusting one or more parameters of the agitation cycle to define a set of adjusted parameters according to the tangle-free option in response to receiving the tangle-free selection signal, the one or more parameters comprising a water volume, a rotational velocity of the agitator, or a rotational arc length of the agitator, wherein the set of adjusted parameters is distinct from one or more unadjusted parameters of the default option; and initiating the washing operation incorporating the set of adjusted parameters.

8. The laundry treatment apparatus of claim 7, wherein adjusting the one or more parameters of the agitation cycle comprises reducing, relative to the default option, the rotational velocity of the agitator within the wash basket during the agitation cycle.

9. The laundry treatment apparatus of claim 7, wherein adjusting the one or more parameters of the agitation cycle comprises reducing, relative to the default option, a rotational stroke time of the agitator within the wash basket during the agitation stroke.

10. The laundry treatment device of claim 7, wherein the default option comprises supplying a first water volume to the tub, and the tangle-free option comprises supplying a second water volume to the tub, the second water volume being less than the first water volume.

11. The laundry treatment apparatus of claim 10, wherein the series of operations further comprises:

draining the second water volume from the tub after performing the agitation cycle for the tangle-free option;

supplying the first water volume to the tub after draining the second water volume; and initiating a rinse operation with the first water volume.

12. The laundry treatment apparatus of claim 7, wherein the tangle-free option is selected by a user before the washing operation is initiated.

13. The laundry treatment apparatus of claim 7, wherein the laundry treatment apparatus is a vertical axis washing machine.

* * * * *